US009756953B2

(12) United States Patent
DeFranks et al.

(10) Patent No.: US 9,756,953 B2
(45) Date of Patent: Sep. 12, 2017

(54) ACTIVE AIRFLOW TEMPERATURE CONTROLLED BEDDING SYSTEMS

(71) Applicant: DREAMWELL, LTD., Las Vegas, NV (US)

(72) Inventors: Michael S. DeFranks, Atlanta, GA (US); James G. Ruehlmann, Cincinnati, OH (US); Richard F. Gladney, Fairburn, GA (US); Emma E. Gardner, Mableton, GA (US)

(73) Assignee: DREAMWELL, LTD, Las Vegas, NV (US)

( * ) Notice: Subject to any disclaimer, the term of this patent is extended or adjusted under 35 U.S.C. 154(b) by 0 days.

(21) Appl. No.: 15/076,901

(22) Filed: Mar. 22, 2016

(65) Prior Publication Data

US 2016/0198861 A1 Jul. 14, 2016

Related U.S. Application Data

(62) Division of application No. 14/151,234, filed on Jan. 9, 2014, now Pat. No. 9,326,616.

(60) Provisional application No. 61/751,140, filed on Jan. 10, 2013, provisional application No. 61/783,014, filed on Mar. 14, 2013.

(51) Int. Cl.

| | |
|---|---|
| ***A47C 21/04*** | (2006.01) |
| ***A47C 27/05*** | (2006.01) |
| ***A47C 27/06*** | (2006.01) |

(52) U.S. Cl.

CPC ..... *A47C 21/044* (2013.01); *A47C 21/048* (2013.01); *A47C 27/05* (2013.01); *A47C 27/064* (2013.01)

(58) Field of Classification Search

CPC ... A47C 21/042; A47C 21/044; A47C 21/048; A47C 27/056; A61G 2007/05784

See application file for complete search history.

(56) References Cited

U.S. PATENT DOCUMENTS

| | | | | |
|---|---|---|---|---|
| 2,462,984 | A | 3/1949 | Maddison | |
| 2,507,750 | A | 5/1950 | Barlow | |
| 3,266,064 | A | 8/1966 | Figman | |
| 4,057,861 | A | 11/1977 | Howorth | |
| 4,491,721 | A | 1/1985 | Davis | |
| 4,825,488 | A | 5/1989 | Bedford | |
| 4,866,800 | A | 9/1989 | Bedford | |
| 5,193,237 | A | 3/1993 | Holdredge | |
| 5,343,893 | A | 9/1994 | Hogan et al. | |
| 7,165,281 | B2 * | 1/2007 | Larssson | A47C 21/044 5/423 |
| 7,877,827 | B2 | 2/2011 | Marquette et al. | |
| 7,908,688 | B2 | 3/2011 | Tompkins | |
| 7,914,611 | B2 * | 3/2011 | Vrzalik | A47C 21/044 5/652.1 |
| 7,996,936 | B2 | 8/2011 | Marquette et al. | |
| 8,065,763 | B2 * | 11/2011 | Brykalski | A47C 21/048 5/421 |
| 8,181,290 | B2 | 5/2012 | Brykalski et al. | |
| 8,191,187 | B2 | 6/2012 | Brykalski et al. | |
| 8,353,069 | B1 | 1/2013 | Miller | |

(Continued)

*Primary Examiner* — Eric Kurilla
(74) *Attorney, Agent, or Firm* — Cantor Colburn LLP

(57) ABSTRACT

A climate controlled bedding system includes at least one coil spring layer; and an air supply fluidly coupled to the one or more fluid conduits. In some embodiments, a filter is disposed within a flow path of a fluid conduit.

5 Claims, 4 Drawing Sheets

(56) References Cited

U.S. PATENT DOCUMENTS

| | | | |
|---|---|---|---|
| 8,359,684 | B2 | 1/2013 | Yoon |
| 2003/0019044 | A1 | 1/2003 | Larsson et al. |
| 2006/0101577 | A1 | 5/2006 | Lussier |
| 2007/0033733 | A1 | 2/2007 | Jen |
| 2007/0044244 | A1 | 3/2007 | Ahn et al. |
| 2007/0136952 | A1 | 6/2007 | Sargent |
| 2007/0261548 | A1 | 11/2007 | Vrzalik et al. |
| 2008/0028536 | A1 | 2/2008 | Hadden-Cook |
| 2008/0098532 | A1 | 5/2008 | Gowda |
| 2008/0148481 | A1 | 6/2008 | Brykalski et al. |
| 2009/0064411 | A1 | 3/2009 | Marquette et al. |
| 2010/0011502 | A1 | 1/2010 | Brykalski et al. |
| 2010/0223732 | A1 | 9/2010 | Allman et al. |
| 2010/0325796 | A1 | 12/2010 | Lachenbruch et al. |
| 2011/0011502 | A1 | 1/2011 | Mei et al. |
| 2011/0067183 | A1 | 3/2011 | Hawkins |
| 2011/0107519 | A1 | 5/2011 | Chen |
| 2011/0119826 | A1 | 5/2011 | Marquette et al. |
| 2011/0258778 | A1 | 10/2011 | Brykalski et al. |
| 2011/0296611 | A1 | 12/2011 | Marquette et al. |
| 2012/0110734 | A1 | 5/2012 | An |
| 2012/0131748 | A1 | 5/2012 | Brykalski et al. |
| 2012/0227182 | A1 | 9/2012 | Brykalski et al. |
| 2013/0025053 | A1 | 1/2013 | Vrzalik et al. |
| 2013/0081207 | A1 | 4/2013 | Cohen |
| 2014/0033441 | A1 | 2/2014 | Morgan et al. |
| 2014/0165292 | A1 | 6/2014 | Gladney |
| 2014/0237726 | A1 | 8/2014 | Gibson et al. |

* cited by examiner

ACTIVE AIRFLOW TEMPERATURE CONTROLLED BEDDING SYSTEMS

CROSS REFERENCE TO RELATED APPLICATIONS

The present application is a DIVISIONAL of U.S. Pat. No. 9,326,616 filed on Jan. 9, 2014 and titled "Active Airflow Temperature Controlled Bedding Systems" which is a Non-Provisional and claims the benefit of U.S. Provisional Application No. 61/751,140 filed on Jan. 10, 2013 and titled "Active Airflow Temperature Controlled Bedding System" and U.S. Provisional Application No. 61/783,014 filed on Mar. 14, 2013 and titled "Active Airflow Temperature Controlled Bedding System". The contents of each of these benefit applications are incorporated by reference for all purposes.

BACKGROUND

The present disclosure generally relates to an active airflow temperature controlled bedding system.

Temperature-conditioned and/or ambient air for environmental control of living or working space is typically provided to relatively extensive areas, such as entire buildings, selected offices, suites of rooms within a building or the like. In the case of enclosed areas, such as homes, offices, libraries and the like, the interior space is typically cooled or heated as a unit. There are many situations, however, in which more selective or restrictive air temperature modification is desirable. For example, it is often desirable to provide an individualized climate control for a bed so that desired heating or cooling can be achieved.

Body temperature is a critical factor for restful sleep. The body prefers that its internal temperature drop slightly in order to fall asleep initially, and this temperature needs to be maintained within a certain range in order to achieve and maintain deep phases of sleep. For example, a bed situated within a hot, poorly-ventilated environment can be uncomfortable to the occupant and make it difficult to achieve desired rest. The user is more likely to stay awake or only achieve disruptive, uneven rest. Furthermore, even with normal air-conditioning, on a hot day, the bed occupant's back and other pressure points may remain sweaty while lying down. In the winter time, it is highly desirable to have the ability to quickly warm the bed of the occupant to facilitate the occupant's comfort, especially where heating units are unlikely to warm the indoor space as quickly. However, if the body temperature is regulated, he or she can fall asleep and stay asleep longer.

Therefore, a need exists to provide a climate-controlled bed assembly with improved heating, cooling and/or ventilation and enhanced control thereof.

BRIEF SUMMARY

Disclosed herein are active airflow temperature controlled bedding systems with improved heating, cooling and/or ventilation. In one embodiment, a climate controlled bedding system comprises a base layer comprising a planar top surface including one or more fluid conduits extending to the planar top surface; a layer overlaying the base layer, the layer comprising one or more perforated conduits in fluid communication with the one or more fluid conduits extending in the base layer to the planar top surface, wherein the one or more perforated conduits are configured to discharge air; a coil spring layer overlaying the layer comprising the one or more perforated conduits; an uppermost foam layer overlaying the coil spring layer, the foam layer including a support surface adapted to substantially face a user resting on the bedding system; and an air supply device fluidly coupled to the one or more fluid conduits.

In another embodiment, a climate controlled bedding assembly comprises a base comprising a cavity, the base having a top porous surface; an air supply device disposed in the cavity and in fluid communication with the top porous surface of the base; a perforated foam layer of overlaying the base; a coil spring layer overlaying the perforated foam layer; and an uppermost foam layer overlaying the coil spring layer, the uppermost the foam layer including a support surface adapted to substantially face a user resting on the bedding system.

In still another embodiment, a climate controlled bedding assembly comprising: a base comprises one or more channels extending from a head end to a foot end, each channel in fluid communication with an air inlet in the base and comprising an air outlet defined by a porous top surface in the base; one or more air supply devices in fluid communication with the air inlet in the base configured to force air into the channel and out the porous top surface; a perforated foam layer of overlaying the base for receiving the forced air; a coil spring layer overlaying the perforated foam layer; and an uppermost foam layer overlaying the coil spring layer, the uppermost the foam layer including a support surface adapted to substantially face a user resting on the bedding system.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are active airflow temperature controlled bedding systems with improved heating, cooling and/or ventilation. As will be discussed in greater detail below, the active airflow temperature controlled bedding system includes a combination of pocketed coils and manifold tubes and/or airflow enabled foundation surfaces. The bedding systems may be of any size, including standard sizes such as a twin, queen, oversized queen, king, or California king sized mattress, as well as custom or non-standard sizes constructed to accommodate a particular user or a particular room. The bedding systems are generally configured as one sided.

Figure 1:
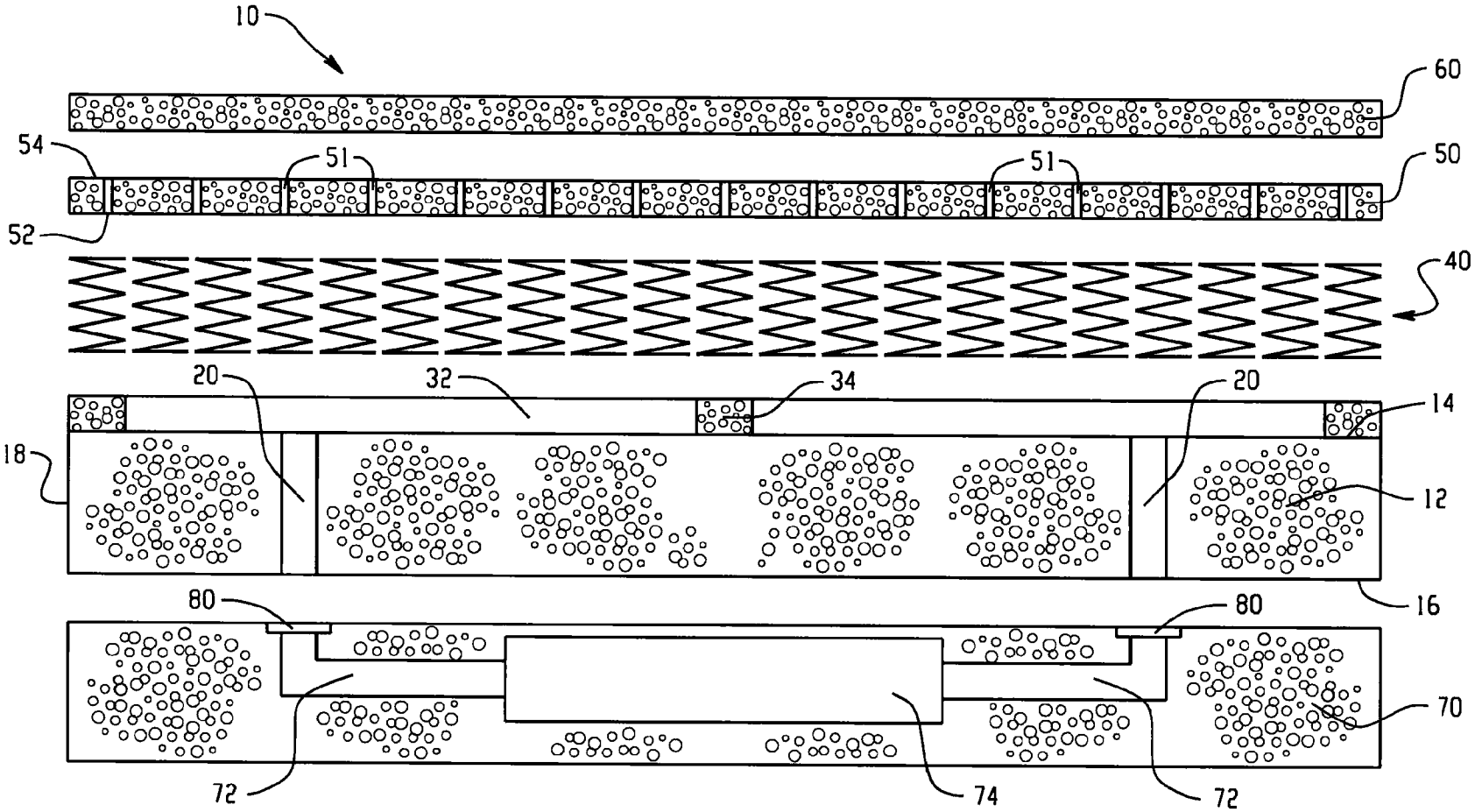
FIG. 1 is an exploded cross sectional view of an active airflow temperature controlled mattress in accordance with the present disclosure.

Referring now to the FIG. 1, there is illustrated an exemplary active airflow temperature controlled bedding system 10 in accordance with an embodiment. The system includes a base foam layer 12 having a planar top surface 14, a planar bottom surface 16, and sidewalls 18 extending therebetween. One or more fluid conduits 20 vertically extend from the bottom surface 16 to the top surface 14. Alternatively, the fluid conduits 20 may extend transversely through a sidewall 18.

Figure 2:
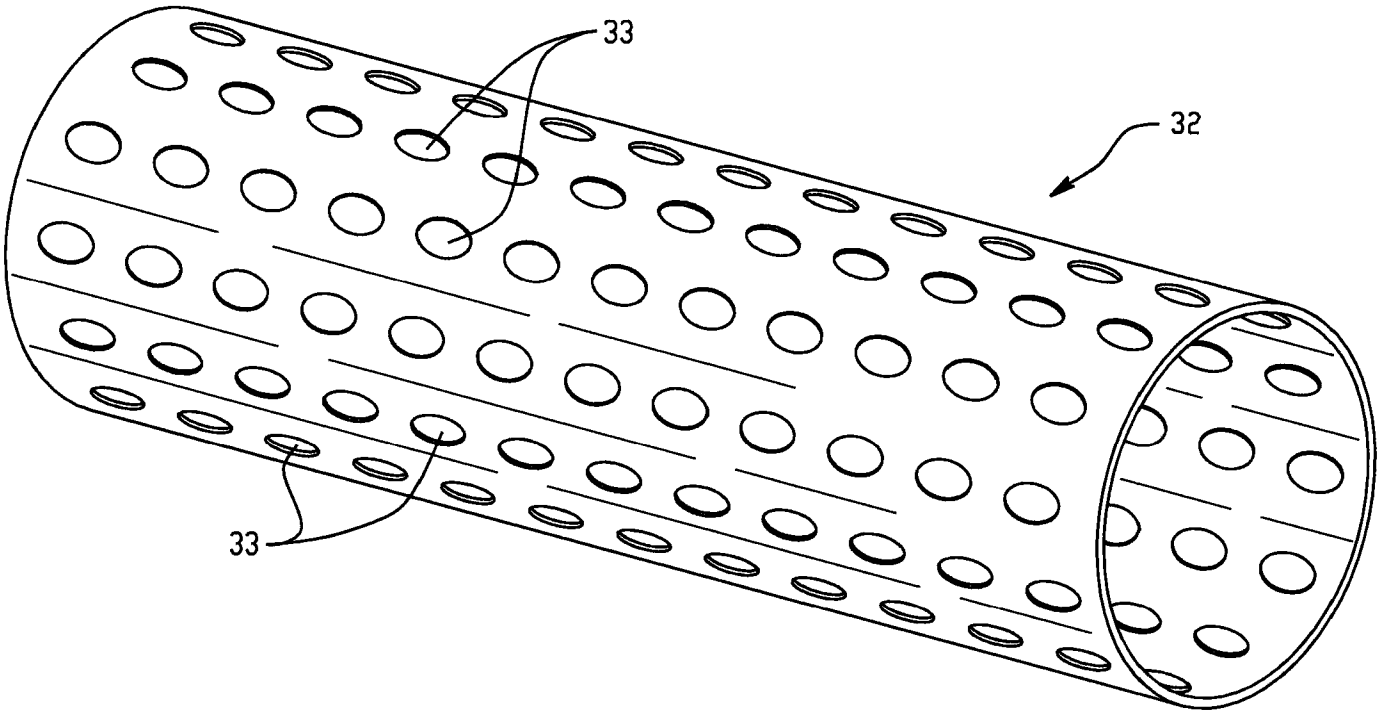
FIG. 2 is a perspective view of an exemplary perforated conduit in accordance with the present disclosure.

One or more ventilated air tubes 32 are laterally disposed about the top surface of the base layer 12 to define a manifold for distributing air (heated, ambient or cooled) to the upper portions of the bedding assembly 10. The ventilated tubes 32 are fluidly coupled to the fluid conduits 20 and are configured to disperse air along its length. For example, perforations in the ventilated tube can provide selective directional flow of air. The particular perforations are not intended to be limited and can be tailored to specific applications. For example, the perforations 33 may disposed symmetrically about the perimeter of the air tube 32 as shown in FIG. 2 or asymmetrically (not shown), e.g., all of the perforations oriented to flow air in an upwards direction relative to ground. The orientation of the ventilated air tubes is not intended to be limited and may extend laterally from one end of the bed to the other end of the bed as shown or may extend transversely from side to side. Still further, the manifold of ventilated tubes can be configured in any shape as may be desired. For example, the ventilated tubes may arranged about the head portion, the lumbar portion, the feet portion and any combination thereof. Moreover, in some embodiments, extending the ventilated air tubes laterally can provide individual temperature control for beds sized to accommodate multiple occupants. Foam 34 having an equivalent thickness as the air tube diameter may be disposed between adjacent air tubes. Alternatively, layer 30 is formed of foam having channels therein dimensioned to accommodate the ventilated air tubes.

An air supply 70 is fluidly coupled to the fluid conduits 20 via conduits 72 in fluid communication with an air blower 74 configured to provide a flow of air through the fluid conduits 72, 20 and through the ventilated tubes 32 to provide air flow to the uppermost layers of the bedding assembly. In some embodiments, the air supply 70 is configured to provide thermoregulated air to provide cooling and/or heating to the user. Exemplary air supplies are disclosed in U.S. Pat. Nos. 8,181,290; 8,191,187; 8,065,763; 7,996,936; and 7,877,827; and US Pat. Pub. Nos. 2012/0227182; 2012/0131748; 2011/0296611; 2011/0258778; 2011/0119826; 2010/0011502; and 2008/0148481; incorporated by reference in their entireties.

By way of example, the air supply 70 can include a fluid transfer device (e.g., blower, fan, etc.), a thermoelectric device (e.g., Peltier device), a convective heater, a heat pump, a dehumidifier and/or any other type of conditioning device. In addition, the air supply 70 can include one or more inlets and outlets (not shown) through which air or other fluid can enter or exit an interior space of the air supply 70. Accordingly, once air or other fluid enters the interior space of the air supply 70 (e.g., through one or more inlets), it can be directed toward the upper layers by one or more fluid conduits 20 and ventilated tubes 32. In embodiments where a fluid module comprises (or is in fluid communication with) a thermoelectric device or similar device, a waste fluid stream can be generated. When cooled air is being provided to the bed assembly (e.g., through one or more passages through or around the upper portion), the waste fluid stream is generally hot relative to the main fluid stream, and vice versa. Accordingly, it may be desirable, in some arrangements, to channel such waste fluid out of the interior of the air supply 70. For example, the waste fluid can be conveyed to one or more outlets (not shown) or other openings positioned along an outer surface of the air supply 70 using a duct or other conduit. In arrangements, where the air supply 70 comprises more than one thermoelectric device, the waste fluid streams from two or more of the thermoelectric devices may be combined in a single waste conduit.

The air supply 70 may be external to the various layers defining the mattress or integrated therein. For example, the air supply can be disposed within the foundation supporting the mattress or may be disposed underneath or positioned to the side of the mattress.

In one embodiment, a filter assembly 80 can be between the air supply 70 and the fluid conduits 20, e.g., between the heating and/or cooling unit 70 and/or in the fluid conduits 72, 20 to remove contaminants in the air. The filter assembly 80 generally includes a filter and filter housing. In addition, motor life can be extended by removal of dust and dirt. In other embodiments, the filter and filter housing can be disposed in air ducts that enter the base of the mattress as shown Suitable filter materials are not intended to be limited and may include foam, or woven and/or non woven materials, pleated or unpleated materials composed of fiberglass, cotton or synthetic fibers. Likewise, the shape of the filter is not intended to be limited. Exemplary shapes include cartridge filters, cone filters, planar filters, and the like.

In still other embodiments, the filter within the assembly 80 may be scented. For example, fragrance pads may be integrated into the filter or positioned in close proximity to the filter. Similarly, the filter may include an activated carbon treatment for absorbing odors and may further include an antimicrobial coating.

Disposed on foam layer 34 and the ventilated tubes 32 is layer 40, which is a layer comprising coils springs. The coil springs may be open coils or may be encased coils, e.g., pocketed (Marshall) coils. In some embodiments, the coil spring layer may further include foam. Bordering the outer row of the coil springs is a side rail (not shown) made, for example, of foam or another suitable material known to those skilled in the art. The side rail may be perforated as may be desired in some applications.

A ventilated foam layer 50 is disposed on coil spring layer 40. The ventilated foam layer includes a plurality of apertures 51 extending from a planar bottom surface 52 to a planar top surface 54. By way of example, the ventilated foam layer may be open cell foam comprising a plurality of tortuous pathways or the foam may be machined with have vertically oriented channels extending from a planar bottom surface to a planar top surface.

Foam layer 60 is disposed on the ventilated foam layer. The foam layer 60 includes a support surface adapted to substantially face a user resting on the bedding system.

Suitable foams for the different layers that include foam, include but are not limited to, polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic foams. Some viscoelastic materials are also temperature sensitive, thereby also enabling the foam layer to change hardness/firmness based in part upon the temperature of the supported part. Unless otherwise noted, any of these foams may be open celled or closed cell or a hybrid structure of open cell and closed cell. Likewise, the foams can be reticulated, partially reticulated or non-reticulated foams. The term reticulation generally refers to removal of cell membranes to create an open cell structure that is open to air and moisture flow. Still further, the foams may be gel infused in some embodiments. The different layers can be formed of the same material configured with different properties or different materials.

The various foams suitable for use in the foam layer may be produced according to methods known to persons ordinarily skilled in the art. For example, polyurethane foams are typically prepared by reacting a polyol with a polyisocyanate in the presence of a catalyst, a blowing agent, one or more foam stabilizers or surfactants and other foaming aids. The gas generated during polymerization causes foaming of the reaction mixture to form a cellular or foam structure. Latex foams are typically manufactured by the well known Dunlap or Talalay processes. Manufacturing of the different foams are well within the skill of those in the art.

The different properties for each layer defining the foam may include, but are not limited to, density, hardness, thickness, support factor, flex fatigue, air flow, various combinations thereof, and the like. Density is a measurement of the mass per unit volume and is commonly expressed in pounds per cubic foot. By way of example, the density of the each of the foam layers can vary. In some embodiments, the density decreases from the lower most individual layer to the uppermost layer. In other embodiments, the density increases. In still other embodiments, one or more of the foam layer can have a convoluted surface. The convolution may be formed of one or more individual layers with the foam layer, wherein the density is varied from one layer to the next. The hardness properties of foam are also referred to as the indention load deflection (ILD) or indention force deflection (IFD) and is measured in accordance with ASTM D-3574. Like the density property, the hardness properties can be varied in a similar manner. Moreover, combinations of properties may be varied for each individual layer. The individual layers can also be of the same thickness or may have different thicknesses as may be desired to provide different tactile responses.

The hardness of the layers generally have an indention load deflection (ILD) of 7 to 16 pounds force for viscoelastic foams and an ILD of 7 to 45 pounds force for non-viscoelastic foams. ILD can be measured in accordance with ASTM D 3575. The density of the layers can generally range from about 1 to 2.5 pounds per cubic foot for non viscoelastic foams and 1.5 to 6 pounds per cubic foot for viscoelastic foams.

Figure 3:
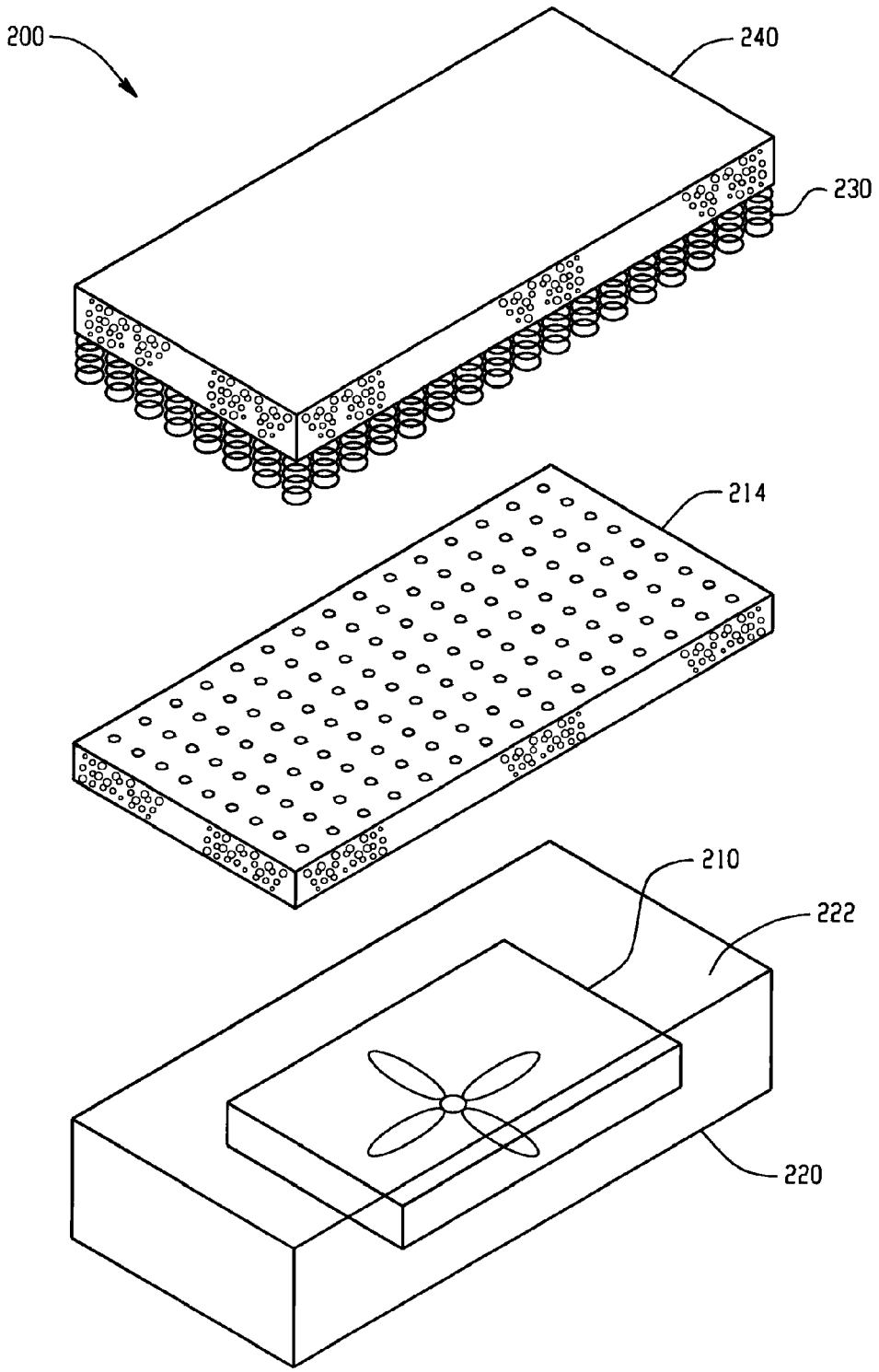
FIG. 3 is an exploded perspective view of an active airflow temperature controlled mattress in accordance with an embodiment of the present disclosure

In other embodiments, the bedding system 200 as shown in FIG. 3 may include one or more air blower assemblies 210 disposed in a cavity of a foundation 220. In this embodiment, the motor and fan assembly 210 are disposed within the cavity. The foundation 220 includes a rigid perforated planar top support 222, e.g., a wire mesh, a perforated support, a breathable fabric, combinations thereof, and the like, such that upward flow of air can be achieved. The motor and fan assembly may be an air transfer device (e.g., blower, fan, etc.), a thermoelectric device (e.g., Peltier device), a convective heater, a heat pump, a dehumidifier, combinations thereof and/or any other type of conditioning device.

A layer of a perforated foam material 214 can then be disposed on the top support 222 of the foundation 220 upon which a coil spring layer is disposed. A coil spring layer 230 overlays the perforated foam material and may further include includes a foam support layer 240 adapted to substantially face a user resting on the bedding system 200. In some embodiments, one or more foam layers (not shown) may be intermediate the uppermost foam layer and the coil spring layer. The intermediate foam layers can be perforated. In other embodiments, the intermediate foam layers can be an open cell foam.

Figure 4:
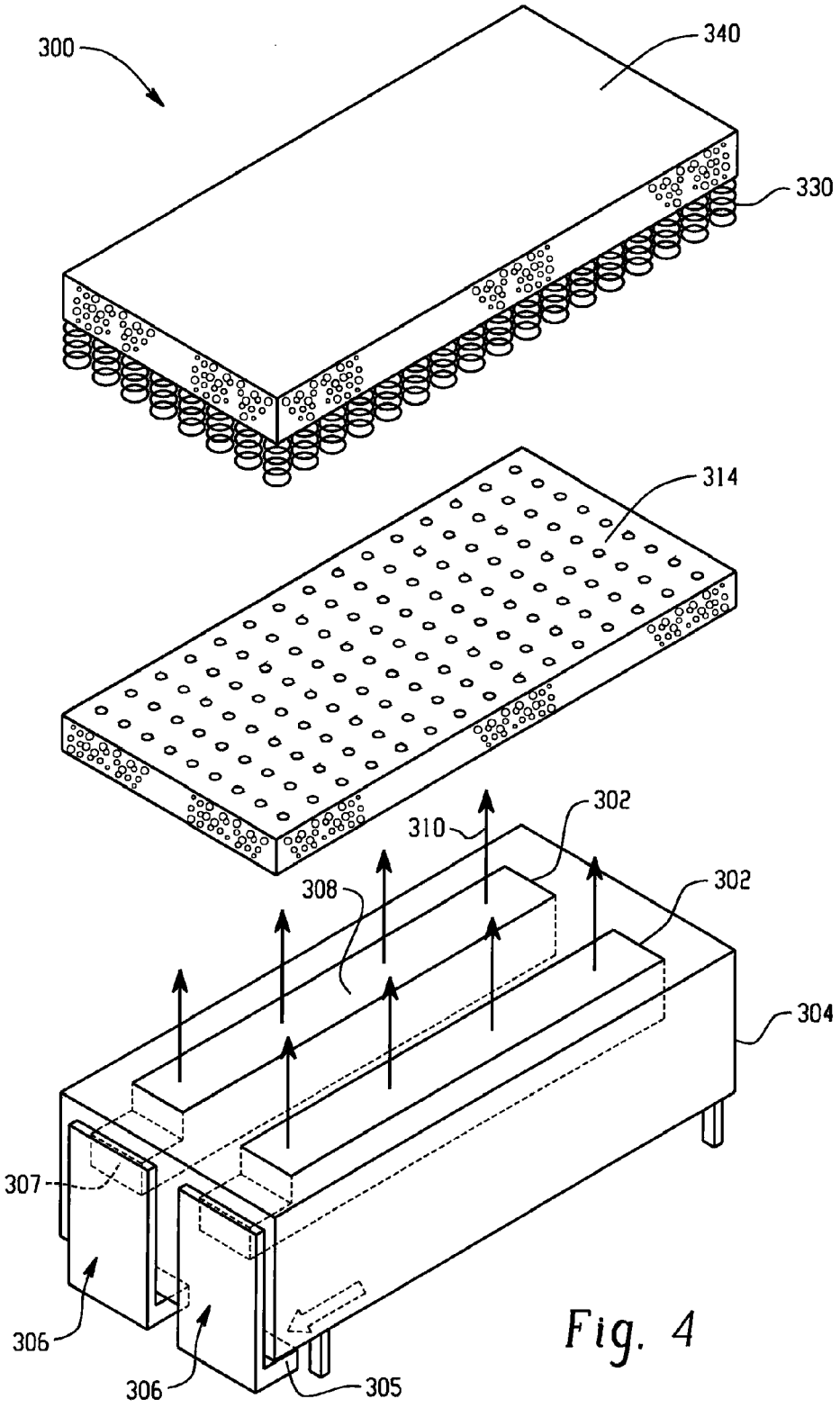
FIG. 4 is an exploded perspective view of an active airflow temperature controlled mattress in accordance with an embodiment the present disclosure

In still another embodiment, a bedding system 300 may include one or more fluid channels 302 within the base 304 as shown in FIG. 4. The channels have one end in fluid communication with one or more air supply devices 306, two of which are shown external to the base. The air supply devices 306 generally include an inlet through which air may be admitted and an exit opening 307 in fluid communication with one end of the channel A fan or the like (not shown) is proximate to the inlet opening 305 such that air can be admitted and forced through the exit opening 307 into the channel 302. Exemplary air supply devices are disclosed in U.S. Pat. No. 7,908,688 and titled "Portable Ventilation System", incorporated herein by reference in its entirety.

The channel has a generally rectangular cross section and is in fluid communication with surface 308 of the base, which can be formed of a breathable fabric, mesh, or perforated surface so as to permit air flowing into the channels via air supply 306 to upwardly flow to layers disposed above the base as shown by arrows 310.

A layer of a perforated foam material 314 can then be disposed on the top of the foundation 304 upon which a coil spring layer is disposed. A coil spring layer 330 overlays the perforated foam material and may further include a foam support layer 340 adapted to substantially face a user resting on the bedding system 300. In some embodiments, one or more foam layers (not shown) may be intermediate the uppermost foam layer and the coil spring layer. The intermediate foam layers may be perforated. In other embodiments, the intermediate foam layers may be an open cell or reticulated foam.

By use of the coil spring layer in the bedding systems, when compared to a mattress that includes a foam layer in place of the coil spring layer, the active airflow temperature controlled bedding system allows heated, ambient, and cooled air to better permeate throughout the length of the mattress and reduces the effect of "hot spots" localized near the airflow channels. Additional features of the active airflow temperature controlled bedding system may include fabric ductwork to create a manifold where the heated or cooled air is forced through a pathway inside the bed to draw more thermo-regulated air to the head and foot of the bed; fabric ductwork to feed airflow through the individual coils for greater control over where the air is delivered to the sleep surface; and specially designed foundation where the thermo-regulated air is pushed through a vented foundation into a perforated foam and coil bed.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A climate controlled bedding assembly comprising:

a base comprising one or more continuous and linear channels extending from a head end to a foot end, and a porous top surface covering the base;

one or more air supply devices that are external to the base, each air supply device having an inlet and an outlet in fluid communication with an open end of each of the one or more continuous channels, wherein each of the one or more continuous channels include outlets in fluid communication with the porous top surface such that air flows from each inlet of the one or more air supply devices, through each outlet of the one or more air supply devices, into each of the one or more continuous channels, and through the outlets of each one or more continuous channels;

a perforated foam layer overlaying and extending an entire length and width of the base for receiving the air flow, wherein the perforated foam layer includes a plurality of vertically oriented channels formed in the perforated foam layer extending from a bottom surface to a top surface;

a coil spring layer overlaying the perforated foam layer;

an uppermost foam layer overlaying the coil spring layer, the uppermost foam layer including a support surface adapted to substantially face a user resting on the bedding system, and wherein the air flow follows a path that goes from outside the base to inside the base, the path changing directions from being substantially parallel to a plane of the bottom surface of the perforated foam layer to being substantially perpendicular to the plane outside the base, then to being substantially parallel to the plane inside the base.

2. The climate controlled bedding system of claim 1, wherein the coil spring layer comprises pocketed coil springs.

3. The climate controlled bedding system of claim 1, wherein the one or more air supply devices are selected from the group consisting of a fluid transfer device, a thermoelectric device, a convective heater, a heat pump, a dehumidifier and combinations thereof.

4. The climate controlled bedding system of claim 1, wherein the base defines a foundation for supporting a mattress, and wherein the mattress comprises the perforated foam layer, the coil spring layer; and the uppermost foam layer including the support surface.

5. The climate controlled bedding system of claim 1, further comprising a filter intermediate each inlet of the one or more air supply devices and the open end of each of the one or more continuous channels.

* * * * *